United States Patent [19]

Shulski

[11] 4,044,280

[45] Aug. 23, 1977

[54] MULTIPLEXED SEGMENTED CHARACTER DISPLAY

[75] Inventor: Anton P. Shulski, St. Charles, Ill.

[73] Assignee: NCR Corporation, Dayton, Ohio

[21] Appl. No.: 627,170

[22] Filed: Oct. 30, 1975

[51] Int. Cl.[2] ..... H05B 37/00; H05B 39/00; H05B 41/00

[52] U.S. Cl. ..... 315/169 TV; 313/220; 313/513; 313/517; 313/519

[58] Field of Search ..... 313/513, 514, 517, 518, 313/519, 220; 315/169 TV

[56] References Cited

U.S. PATENT DOCUMENTS

| | | | |
|---|---|---|---|
| 3,711,733 | 1/1973 | Skutt | 313/517 |
| 3,725,713 | 4/1973 | Kupsky | 313/220 |
| 3,760,403 | 9/1973 | Kippenhan | 313/518 |
| 3,781,863 | 12/1973 | Fujita | 313/517 |
| 3,811,060 | 5/1974 | Tsujimoto | 313/518 |
| 3,855,500 | 12/1974 | Yanagisawa | 313/517 |
| 3,938,140 | 2/1976 | Garcia et al. | 313/513 |

*Primary Examiner*—Saxfield Chatmon, Jr.
*Attorney, Agent, or Firm*—J. T. Cavender; Lowell C. Bergstedt

[57] ABSTRACT

An enclosure containing an ionizable gas has electrodes mounted in opposition on opposite faces of the enclosure. A first set of electrodes on one side of the enclosure are energized in sequence. A second set of electrodes on the opposite side of the enclosure form a multiple-element character matrix in which groups of elements are electrically commoned so that the number of electrodes, and respective leads thereto, in the second set is less than the number of elements of the matrix. The electrodes of the first set are mounted and shaped so that each is opposite a plurality of electrodes of the first set, and so that the same electrode of the second set is opposite several electrodes of the first set. Thus different portions of the same electrodes of the first set, representing different elements of the matrix, can be separately actuated during the different time periods of energization of the electrodes of the first set. Thereby a time division multiplexed mode of operation of the character display is provided such that the number of leads to the display can be reduced significantly.

18 Claims, 3 Drawing Figures

FIG. 3

| DISPLAY NUMBER | TIME PERIOD & ACTIVATED FRONT ELECTRODE | | |
|---|---|---|---|
| | 1 | 2 | 3 |
| 0 | XY | XZ | YZ |
| 1 | Y | Z | |
| 2 | XY | Y | YZ |
| 3 | XY | YZ | Z |
| 4 | Y | XYZ | |
| 5 | X | XYZ | Z |
| 6 | X | XYZ | YZ |
| 7 | XY | Z | |
| 8 | XY | XYZ | YZ |
| 9 | XY | XYZ | Z |
| DECIMAL POINT | | | X . |

MULTIPLEXED SEGMENTED CHARACTER DISPLAY

BACKGROUND OF THE INVENTION

1. Field of the Invention

This invention relates to plasma (ionized gas) character displays and particularly to a plasma display employing a multisegment matrix operable in the time division multiplexed (TDM) mode to reduce the number of energizing leads required.

2. Description of Prior Art

Heretofore gas plasma displays, such as used on electronic calculators and electronic digital watches, comprised an enclosure containing an ionizable gas with front and rear electrodes mounted on opposite faces of the enclosure for selectively ionizing the gas between energized opposing electrodes. The electrodes can be in direct contact with the gas, in which case the electrodes can be energized with a direct current voltage, or the electrodes can be insulated from, yet capacitively coupled to, the gas, in which case an alternating current energizing voltage is required. AC-type insulated-electrode plasma displays are currently sold by the National Electronics Division of Varian Associates, Geneva, IL, under the trademark Plasmac and are described in New Electronics, Sept. 17, 1974, pp. 82–87, and Electronics, Nov. 18, 1973, and Jan. 10, 1974, pp. 123–128.

Both types of plasma displays suffer from the disadvantage that individual leads must be connected to the respective electrodes which represent respective elements or bars of the matrix on one side of the panel, together with a lead to a common electrode on the other side of the panel. In a single character display for displaying a numeral and utilizing the familiar seven-segment "matrix 8", seven leads are required for the respective elements of the matrix and one lead is required for the common electrode on the other side of the display, for a total of eight leads. While this requirement is not onerous, when multiple characters must be displayed, the number of requisite leads and their connections to the panel presents a redoubtable problem. For example, in an eight-digit panel, 57 external leads to drive the panel are required: seven leads to each character station ($8 \times 7 = 56$), plus one lead for the common front electrode. Thus, 57 conductive pathways must be provided on the panel itself, and 57 mechanical and electronic connections must be made to the panel for these leads. This is a serious disadvantage and leads to problems of increased cost, poor reliability, etc., as will be recognized by those skilled in the art.

In accordance with the present invention, the number of leads required for an eight-digit panel can be reduced by over 50% i.e., from 57 to 27 leads. Even greater percentage reductions in number of leads can be effected for panels with more than eight digits. The reduction in number of connections to the panel, as well as the reduction in the number of leads on the panel itself and concomitant reduction in crowding is quite desirable. The above and other advantages of the invention will become apparent from a consideration of the ensuing description thereof.

BRIEF DESCRIPTION OF THE DRAWINGS AND REFERENCE CHARACTERS

FIG. 3 is a truth table showing how one character station of the panel of FIG. 1 is driven electrically.

| | |
|---|---|
| 1 | Buss to upper-front electrodes |
| 2 | Buss to middle-front electrodes |
| 3 | Buss to lower-front electrodes |
| I-A | Top horiz. bar (rear electrode matrix—Stage I) |
| I-B | Upper right vert. bar (rear electrode matrix—Stage I) |
| I-C | Lower right vert. bar (rear electrode matrix—Stage I) |
| I-D | Lower horiz. bar (rear electrode matrix—Stage I) |
| I-E | Lower left vert. bar (rear electrode matrix—Stage I) |
| I-F | Upper left vert. bar (rear electrode matrix—Stage I) |
| I-G | Middle horiz. bar (rear electrode matrix—Stage I) |
| I-X | Upper left electrode of Stage I (bars A and F) |
| I-Y | Middle electrode of Stage I (bars B, G, and D) |
| I-Z | Lower right electrode of Stage I (bars C and D) |
| 11 | Upper front electrode of Stage I |
| 12 | Middle front electrode of Stage I |
| 13 | Lower front electrode of Stage I |
| 30 | Drive circuit |
| 32 | Front glass plate |
| 34 | Front electrode (transparent) |
| 36 | Front dielectric layer (transparent) |
| 37 | Segment cavity outline wall—front |
| 38 | Ionizable gas |
| 39 | Segment cavity outline wall—rear |
| 40 | Back dielectric (black) |
| 42 | Rear electrode |
| 44 | Rear glass plate |

DESCRIPTION OF THE PREFERRED EMBODIMENTS

Figure 1:
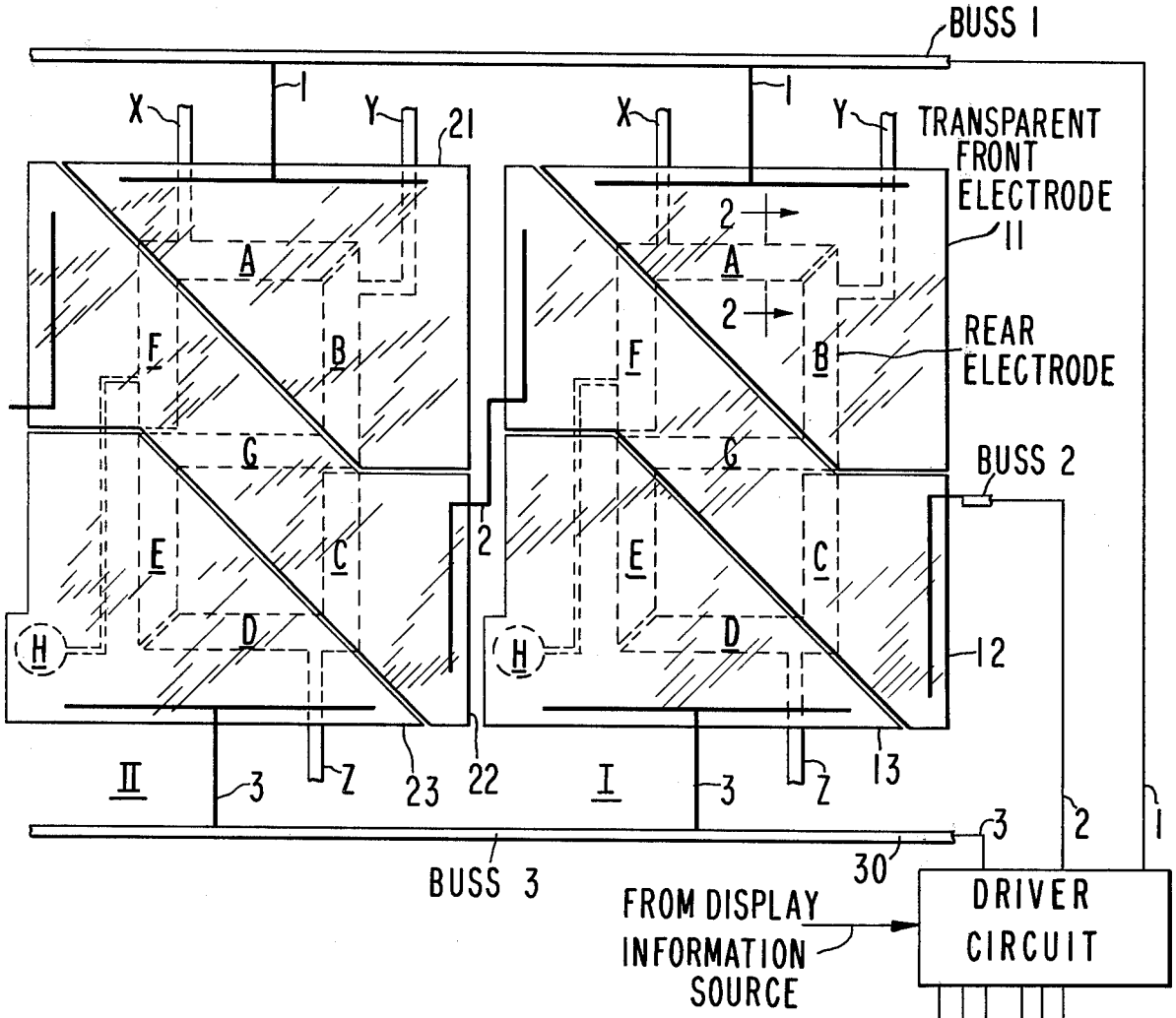
FIG. 1 shows the front and rear electrodes of a display panel according to the invention.

The electrode configuration of the display according to the invention is shown in FIG. 1; for purposes of facilitation of illustration only two numerical character display stations of a multi-station character display are shown. Each display station comprises a set of rear electrodes (shown in broken lines) arranged in the familiar seven-element "matrix 8" which, through energization of the proper combinations of electrodes, can display any arabic digit 0 to 9. Each station also has a decimal point rear electrode to the left of each matrix 8. Each station also comprises a set of three transparent front electrodes 11, 12, and 13.

The configurations of the electrodes with respect to the gas and the actual enclosure itself can best be seen in the sectional view of FIG. 2, which will be discussed prior to detailing the electrode configuration of FIG. 1. The enclosure comprises front and rear glass plates 32 and 44 sealed together with the usual spacers and hermetic frit seal such that the glass plates, which may be about ⅛th inch or 3 mm thick, are mounted apart about 10 mils or 0.25 mm. The enclosure is filled with an ionizable gas 38 such as neon or a mixture of neon and another inert gas such as argon or krypton to provide the desired glow color when ionized.

Behind front plate 32 the front electrodes and their busses and connections are deposited as films. A section of a typical front electrode 34 is shown in FIG. 2. The front electrodes are transparent so that the glow behind them can be seen and preferably are formed of tin oxide in a layer about 2500 angstroms thick. The front electrodes are relatively larger than necessary to cover the rear electrodes since SnO has a relatively high resistivity and a large area electrode is necessary in order that the electrode will not have too much resistance. The busses and connections to the transparent front electrodes such as 34 can be masked so as not to be conductive to the cell and thereby can be made of a low resistance, albeit opaque, material such as layer of silver 0.5 mil (13 microns) thick. Behind front electrodes 34 is mounted a front dielectric layer 36, such as glass, screened to be about 0.7 mil or 18 microns thick so as to be transparent. Behind dielectric layer 36 segment cavity outline walls such as 37 are formed to define the front portions of cavities which define the segments of the matrix 8 and the decimal point.

On the inside of rear glass plate 44 is mounted the rear electrodes (shown broken in FIG. 1) in the shape of the individual character matrices. These are not visible from the front of the tube since they are covered by a back dielectric layer 40, preferably of screened black glass. Rear electrodes 42 may be made of silver, 1/2 mil (13 microns) thick. Behind dielectric layer 40, complimentary rear segment cavity outline walls such as 39 are formed to define the rear portions of the segments.

Figure 2:
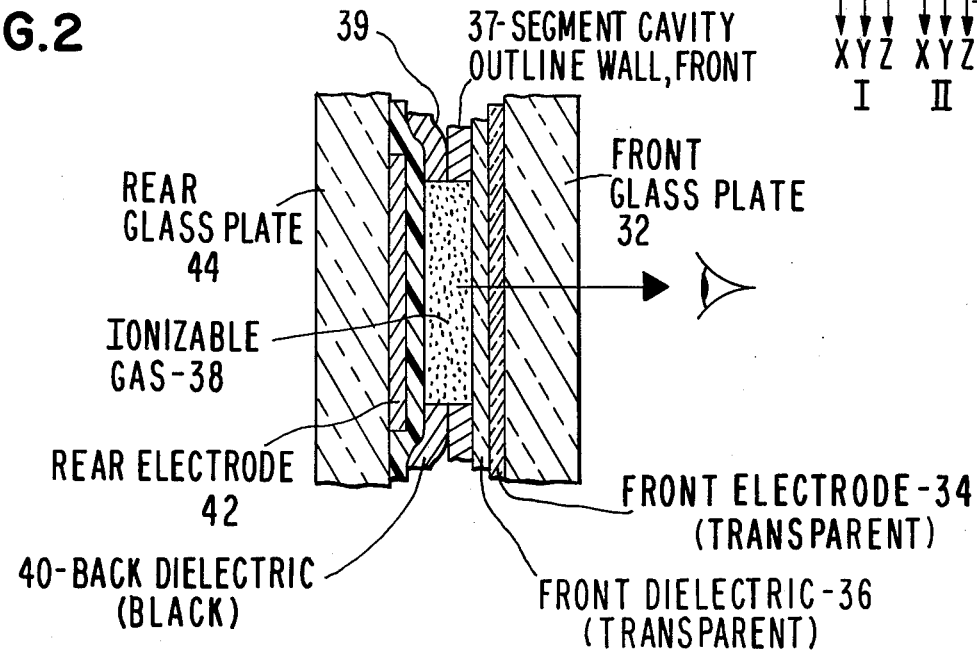
FIG. 2 is a sectional side view of the panel of FIG. 1.

The sectional view of FIG. 2 is taken at a point to show both the rear and the front electrodes. However, as will be appreciated from a view of FIG. 2, many portions of the front and rear glass plates do not have any electrodes thereon and in such portions the front and back dielectric layers 36 and 40 lie directly on their respective glass plates.

The characters can be any height or size desired and the front electrodes should be about one and one-half to two times the size of the character matrix, as illustrated in FIG. 1.

Returning to FIG. 1, and particularly to the rear electrodes shown in broken lines at character station I, note that there are three electrodes, X, Y, and Z. As described above in the list of reference characters, electrode X comprises two electrically common bar elements of the matrix, namely A and F plus the decimal point H; electrode Y comprises three such bar elements, B, G, and E; and electrode Z comprises two such bar elements, C and D. Electrodes X, Y, and Z are electrically separate for each character station and are connected to respective driver leads from driver circuit 30.

The front, transparent electrodes 11, 12 and 13 are mounted and shaped such that electrode 11 is opposite and covers the portion of electrode X comprising matrix bar element A and the portion of electrode Y comprising bar B. Electrode 12 covers bar F of electrode X, bar G of electrode Y, and bar C of electrode Z. Front electrode 13 covers bar E of electrode Y, bar D of electrode Z, and decimal point H of electrode X.

It will thus be noted that each rear electrode is mounted opposite and overlaps at least two front electrodes and each front electrode is mounted opposite and overlaps portions of at least two rear electrodes. The separation between front electrodes 11 and 12 is opposite the junction of bar elements A and F, plus bars and B and G. The separation between front electrode 12 and 13 is opposite the junction between bar elements G and E, the junction between bars C and D, and the junction between decimal point H and segment F.

The electrodes at station II and each succeeding station (not shown) are similar to those of station I.

A driver circuit 30, which may be a separate IC (integrated circuit) or part of a larger integrated circuit, drives the display. Driver circuit 30 has three outputs, 1, 2, and 3, connected to drive respective busses 1, 2, and 3 which are connected in common to the respective front electrodes of each station. Thus output 1 of driver circuit 30 is connected to drive all of the upper right transparent front electrodes, including electrode 11 of Stage I and electrode 21 of Stage II. Output 2 of driver circuit 30 is connected to drive the middle transparent front electrode of each stage, including electrode 12 of Stage I and electrode 22 of Stage II, while output 3 is connected to drive the lower left front electrode of each stage, including electrode 13 of Stage I and electrode 23 of Stage II.

The rear electrodes of each stage are driven individually. Thus, driver circuit 30 has three outputs (I: X,Y,Z) for Stage I, three separate outputs (II: X,Y,Z) for Stage II, etc. In practice, as will be described below, front busses 1, 2, and 3 are sequentially energized and rear electrodes X, Y and Z of the stages are synchronously energized to display the desired character information.

OPERATION

The operation can be best be understood by a description of an example thereof. Assume that it is desired to display at stage I the arabic character "O" as indicated in the top row of the "display number" or first column of FIG. 3. The "O" will be displayed in three parts, in three respective, sequential time periods, 1, 2, and 3. These periods correspond to the sequential times of energization of front electrodes 11, 12, and 13, as indicated in the second, third and fourth columns of FIG. 3.

During the first time period (column head "1") buss 1 is energized, causing front electrode 11 to be energized. During this time period, as indicated, electrodes I-X and I-Y are also energized with respect to buss. As a result, bar elements A and F, and B, G, and E, are energized. However since front electrode 11 covers or is only opposite elements A and B, only the gas between electrode 11 and elements A and B will have a potential thereacross so that only the gas adjacent elements A and B will glow during time period 1, as depicted in the block opposite O in time period 1.

During time period 2, buss 2 is energized, and as indicated in the chart, rear electrodes X and Z are energized, as a result of which the gas between electrode 12 and bar elements F and C will glow, as indicated.

During time interval 3, buss 3 is energized and rear electrodes Y and Z are also energized, causing bar elements E and D to glow, as indicated in FIG. 3.

It will be seen that during time periods 1, 2, and 3, all of the elements of the matrix necessary to display the O (A, B, C, D, E, & F) will be energized, albeit in successive time periods. The sequential energization of busses 1, 2, and 3, and the corresponding energization of rear electrodes XY, XZ, and YZ in these respective time periods, occurs repetitively at a rapid enough rate so that when seen by an observer, the station will appear to display continuously a non-fluctuating O.

Electrodes 1, 2 and 3 are preferably pulsed sequentially and repetitively at a rate of about 100 Hz. The energizing voltages should be such that the potential between the front and rear electrodes is about 150 volts, alternating at a frequency of about 120 kHz. This would give a typical brightness of 200 fL (foot lamberts).

In the case of a dc panel, in which the electrodes are not insulated from the gas, this voltage should be about 190 volts and the minimum repetition rate at which the front busses 1, 2, and 3 are energized should be about 100 Hz.

As will be observed from the truth table, any of the other arabic characters or the decimal point can be displayed by energizing the proper rear electrodes, X, Y, and Z, during the respective time periods 1, 2, and 3. The necessary logic circuitry for driver circuit 30 will be apparent to anyone skilled in the art, once the parameters of the display information (not illustrated) for driving circuit 30 are known.

It is seen that through the use of the time multiplexed mode of operation, in which front electrodes overlap plural rear electrodes and vice-versa, the number of requisite electrodes to a multi-character display can be greatly reduced.

While the above description contains many specificities, these sould not be construed as limitations upon the scope of the invention, but rather as an exemplification of one preferred embodiment thereof. Various other embodiments and ramifications will be apparent to those skilled in the art. For example, in lieu of a numerical display, other multiplexed matrix configurations for displaying alphbetical, geometrical, roman, oriental, or any other types of characters will be apparent. Also, many other types of display panels than the one illustrated and the ones described which utilize the principles of the invention will also be readily envisaged. Therefore the true scope of the invention should be determined only by the appended claims and their legal equivalents.

What is claimed is:

1. In a segmented-matrix character display of the type comprising an enclosure containing a display medium and a plurality of opposing electrodes actively coupled electrically across at least a quantity of said display medium, the improvement wherein:

a first set of at least three electrically separated electrodes is positioned on one side of said quantity of said display medium, a second set of at least three electrically separate electrodes is positioned on an opposite side of said quantity of said display medium, said second set of electrodes being positioned and shaped to form a multiple-character matrix of the type in which selected combination of elements forming said matrix can be actuated to display respective differently-shaped characters, at least one of said electrodes of said second set forming a plurality of elements of said matrix, which plurality of elements are commonly connected electrically, said first set of electrodes being positioned and shaped such that a projection thereof across said display medium on said second set of electrodes will cover said second set of electrodes, at least two adjacent electrodes of said first set being positioned so that a projection of the separation therebetween across said display medium will lie on said one electrode of said second set at a locus which divides said first electrode into a pair of adjacent elements of said matrix.

2. The display of claim 1 further including means for applying driving voltages to said electrodes, said voltages being sufficient to activate said display medium between driven electrodes, said means arranged to apply said driving voltages such that the individual electrodes of said first set are sequentially energized with respect to selected electrodes of said second set such that elements of a complete character will be actuated in sequence.

3. The display of claim 2 wherein said second set of electrodes are positioned and shaped to form a matrix in the shape of the numeral "8", said set consisting of less than seven electrodes.

4. The display of claim 3 wherein said second set of electrodes also includes a portion arranged to display a decimal point.

5. The display of claim 1 wherein said display medium comprises an ionizable gas, and said electrodes are electrically insulated from, yet capacitively coupled to, said gas.

6. The display of claim 1 wherein said second set of electrodes are positioned and shaped to form a matrix the shape of the numeral "8", said set consisting of less than seven electrodes.

7. The display of claim 1 wherein said second set of electrodes are positioned and shaped to form a matrix in the shape of the numeral 8, the elements of said matrix comprising three parallel horizontal bars, the ends of the middle and top bars being joined by a left and right upper vertical bars, the ends of the middle and bottom bars being joined by left and right lower vertical bars, the upper horizontal and upper left vertical bars being connected electrically, the upper right vertical, middle horizontal, and lower left vertical bars being connected electrically, and the lower right vertical and bottom horizontal bars being connected electrically, and wherein said first set of electrodes are three in number, a first of which is mounted opposite said upper horizontal and upper right vertical bars, a second of which is mounted opposite said upper left vertical, middle horizontal and lower right vertical bars, and a third of which is mounted opposite said lower left vertical and lower horizontal bars.

8. The display of claim 7 further including means for energizing said first set of electrodes in numerical order sequentially with respect to selected ones of said second set of electrodes so as to display selected numerical characters by displaying portions thereof sequentially.

9. The display of claim 1, wherein a plurality of said first and second sets of electrodes is provided to form a corresponding plurality of character display stations, and each of the corresponding electrodes in said first sets thereof are connected in common to corresponding ones of a first set of driving signal busses and each of the electrodes in said second sets are connected to individual driving signal busses in a corresponding plurality of second sets thereof.

10. The display of claim 9, further comprising a time division multiplex display driving means for repetitively applying driving signals to each of said driving signal busses of said first set during sequential time periods and for applying driving signals to preselected ones of said driving signal busses in said second sets during each of said sequential time periods to produce a displayed character at each of said character display stations.

11. A character display comprising an enclosure containing an ionizable gas and electrodes on opposite sides of said enclosure actively coupled to said gas, characterized in that on one side of said enclosure the electrodes are at least three in number, constituting a first set, and on the other side of said enclosure, the electrodes are also at least three, in number, constituting a second set, and are arranged in a multi-element character display matrix, at least one electrode of said second set forming plural elements of said matrix and lying opposite plural electrodes of said first set such that said one electrode of said second set and one of said electrodes of said first set can jointly be energized to ionize the gas therebetween, at least one electrode of said first set lying opposite plural electrodes of said second set such that said one electrode of said first set and one of said electrodes of said second set can jointly be energized to ionize the gas therebetween.

12. The display of claim 11 further including means for applying driving voltages to said electrodes, said voltages being sufficient to ionize the gas between driven electrodes, said means arranged to apply said driving voltages such that the individual electrodes of said first set are sequentially energized with respect to selected electrodes of said second set such that elements of a complete character will be actuated in sequence.

13. The display of claim 12 wherein said second set of electrodes are positioned and shaped to form a matrix the shape of the numeral 8, said set consisting of less than seven electrodes.

14. The display of claim 11 wherein said electrodes are electrically insulated from, yet capacitively coupled to, said gas.

15. The display of claim 11 wherein said second set of electrodes are positioned and shaped to form a matrix the shape of the numeral 8, said set consisting of less than seven electrodes.

16. The display of claim 11 wherein said second set of electrodes are positioned and shaped to form a matrix in the shape of the numeral 8, the elements of said matrix comprising three parallel horizontal bars, the ends of the middle and top bars being joined by a left and right upper vertical bars, the ends of the middle and bottom bars being joined by left and right lower vertical bars, the upper horizontal and upper left vertical bars being connected electrically, the upper right vertical, middle horizontal, and lower left vertical bars being connected electrically, and the lower right vertical and bottom horizontal bars being connected electrically, and wherein said first set of electrodes are three in number, a first of which is mounted opposite said upper horizontal and upper right vertical bars, a second of which is mounted opposite said upper left vertical, middle horizontal and lower right vertical bars, and a third of which is mounted opposite said lower left vertical and lower horizontal bars.

17. The display of claim 11, wherein a plurality of said first and second sets of electrodes is provided to form a corresponding plurality of character display stations, and each of the corresponding electrodes in said first sets thereof are connected in common to corresponding ones of a first set of driving signal busses and each of the electrodes in said second sets are connected to individual driving signal busses in a corresponding plurality of second sets thereof.

18. The display of claim 17, further comprising a time division multiplex display driving means for repetitively applying driving signals to each of said driving signal busses of said first set during sequential time periods and for applying driving signals to preselected ones of said driving signal busses in said second sets during each of said sequential time periods to produce a displayed character at each of said character display stations.

* * * * *